US005563379A

United States Patent [19]

Kunieda et al.

[11] Patent Number: 5,563,379

[45] Date of Patent: Oct. 8, 1996

[54] COMPOSITE ELECTRICAL INSULATOR

[75] Inventors: Shigehiko Kunieda, Iwakura; Takeshi Shogo, Kani, both of Japan

[73] Assignee: NGK Insulators, Ltd., Japan

[21] Appl. No.: 216,582

[22] Filed: Mar. 23, 1994

[30] Foreign Application Priority Data

Mar. 25, 1993 [JP] Japan ..... 5-066671

[51] Int. Cl.[6] ..... H01B 17/06

[52] U.S. Cl. ..... 174/169; 174/176; 174/179; 174/209

[58] Field of Search ..... 174/169, 176, 174/178, 179, 180, 181, 182, 74 R, 152 R, 158 R, 209, 141 R, 75 R, 192, 177, 80, 188, 189, 193

[56] References Cited

U.S. PATENT DOCUMENTS

| | | | |
|---|---|---|---|
| 1,979,092 | 10/1934 | Austin | 174/189 |
| 2,072,201 | 3/1937 | Dibble | 174/189 |
| 3,358,073 | 12/1967 | Gamble | 174/189 |
| 3,898,372 | 8/1975 | Kalb . | |
| 4,296,276 | 10/1981 | Ishihara et al. . | |
| 4,303,799 | 12/1981 | Ishihara et al. . | |
| 4,654,478 | 3/1987 | Ishihara et al. . | |

FOREIGN PATENT DOCUMENTS

| | | | |
|---|---|---|---|
| 2262427 | 9/1975 | France | 174/80 |
| 2419571 | 11/1979 | France | 174/177 |
| 2542665 | 9/1984 | France . | |
| 2588690 | 4/1987 | France . | |
| 2063581 | 6/1981 | United Kingdom . | |

*Primary Examiner*—Kristine L. Kincaid
*Assistant Examiner*—Paramita Ghosh
*Attorney, Agent, or Firm*—Parkhurst, Wendel & Burr, L.L.P.

[57] ABSTRACT

A composite electrical insulator (1) includes a plastic rod (2), e.g., an FRP rod, which is covered by a sheath which includes a resilient and electrically insulating material. A metal fitting (4, 5) on each side of the insulator (1) has a radially inwardly deformable sleeve portion formed with a bore in which the end portion of the plastic rod (2) is covered by the sheath (3). The end portion of the sheath (3) has an outer surface opposite to the metal fitting (4, 5), which is provided with at least one circumferential ridge (7*a*, 7*b*).

6 Claims, 4 Drawing Sheets

COMPOSITE ELECTRICAL INSULATOR

BACKGROUND OF THE INVENTION

1. Field of the Invention

The present invention relates generally to a composite electrical insulator wherein a metal fitting is fixedly secured to one end of a plastic rod which is covered by an insulating sheath.

2. Description of the Related Art

A composite electrical insulator with such a constitution is known, e.g., from U.S. Pat. No. 4,654,478, wherein a fiber-reinforced plastic rod is covered by a sheath comprising a resilient and electrically insulating material, such as silicone rubber, ethylenepropylene rubber and the like, and one end portion of the plastic rod as covered by the sheath is inserted into the bore in a sleeve portion of the metal fitting and the metal fitting is then fixedly secured to the plastic rod. Such a composite insulator makes use of advantages of various materials, e.g., an improved resistance to tensile force and an excellent weight to strength ratio of the fiber reinforced plastic material, and distinguished weatherability and anti-tracking characteristics of silicone rubber, ethylenepropylene rubber or the like.

To manufacture such composite insulators, the sleeve portion of the metal fitting is usually compressed radially inwardly onto the plastic rod so as to firmly clamp the rod. That is to say, by compressing the sleeve portion radially inwardly, the end portion of the plastic rod situated opposite to the metal fitting is uniformly and tightly clamped to integrally connect the metal fitting with the plastic rod and prevent withdrawal of the plastic rod from the fitting even under a large tensile force, while maintaining a water-tight state inner the annular space between the outer surface of the sheath and the inner surface of the sleeve portion of the metal fitting.

Typically, the metal fitting is subjected to a dip-plating so that the outer surface of the metal fitting is more or less uneven. In this instance, an insufficient clamping force tends to form a gap between the metal fitting and the sheath, often making it difficult to preserve the required tightness. A deteriorated tightness results in intrusion of water from outside into the space between the metal fitting and the sheath, and hence in a difficulty to maintain the required electrical insulating property, possibly giving rise to an internal destruction due to flashover.

While a required tightness may be realized by an increased clamping force, the resilient material forming the sheath would then be maintained in an excessively compressed state and thus undergo a gradual deterioration in the restoring characteristic so that it would be impossible to achieve the required sealing function any more. A similar problem may arise also when an increased clamping force causes the sheath to expand radially outwardly to deteriorate the adhesive characteristic of the adhesive material interposed between the sheath and the rod.

SUMMARY OF THE INVENTION

It is therefore an object of the present invention to provide an improved composite electrical insulator, which is capable of maintaining the water-tightness between the metal fitting and the sheath without an increased clamping force.

According to the present invention, there is provided a composite electrical insulator comprising: a rod comprised of an electrically insulating plastic material, and having an end portion; a sheath covering the rod and comprised of a resilient and electrically insulating material; and a metal fitting having a sleeve portion formed with a bore in which said end portion of the rod as covered by said sheath is received, said sleeve portion having a radially inwardly deformed region for tightly clamping the end portion of the rod; wherein said end portion of the sheath has an outer surface opposite to said metal fitting, which is provided with at least one circumferential ridge.

With the above-mentioned arrangement in accordance with the present invention, the outer surface of the end portion of the sheath situated opposite to the metal fitting has at least one circumferential ridge which is brought into contact with the inner surface of the bore in the metal fitting. Thus, when the sleeve portion of the metal fitting is applied with a moderate clamping force, the circumferential ridge is compressed by the metal fitting into conformity with any unevenness on the inner surface of the metal fitting, thereby maintaining the desired water-tightness for a long period.

Preferably, the outer surface of the sheath is provided with a plurality of circumferential ridges which are axially spaced from each other by a predetermined distance. These ridges provide a further improved double seal structure. The circumferential ridge may have a semi-circular cross-section.

Advantageously, the outer surface of the sheath terminates in a generally frustoconical free end having a radially innermost surface region which is axially depressed. The depressed surface region at the free end where the outer surface of the sheath terminates serves to positively prevent separation of the sheath from the rod upon thermal expansion or cooling shrinkage of the sheath.

Preferably, the metal fitting has an end region adjacent to the sheath, and a sealant resin is applied to a junction between the end region of the metal fitting and the outer surface of the sheath.

BRIEF DESCRIPTION OF THE DRAWINGS

The present invention will be further explained in detail hereinafter with reference to the accompanying drawings, in which.

DESCRIPTION OF THE PREFERRED EMBODIMENT

Figure 1:
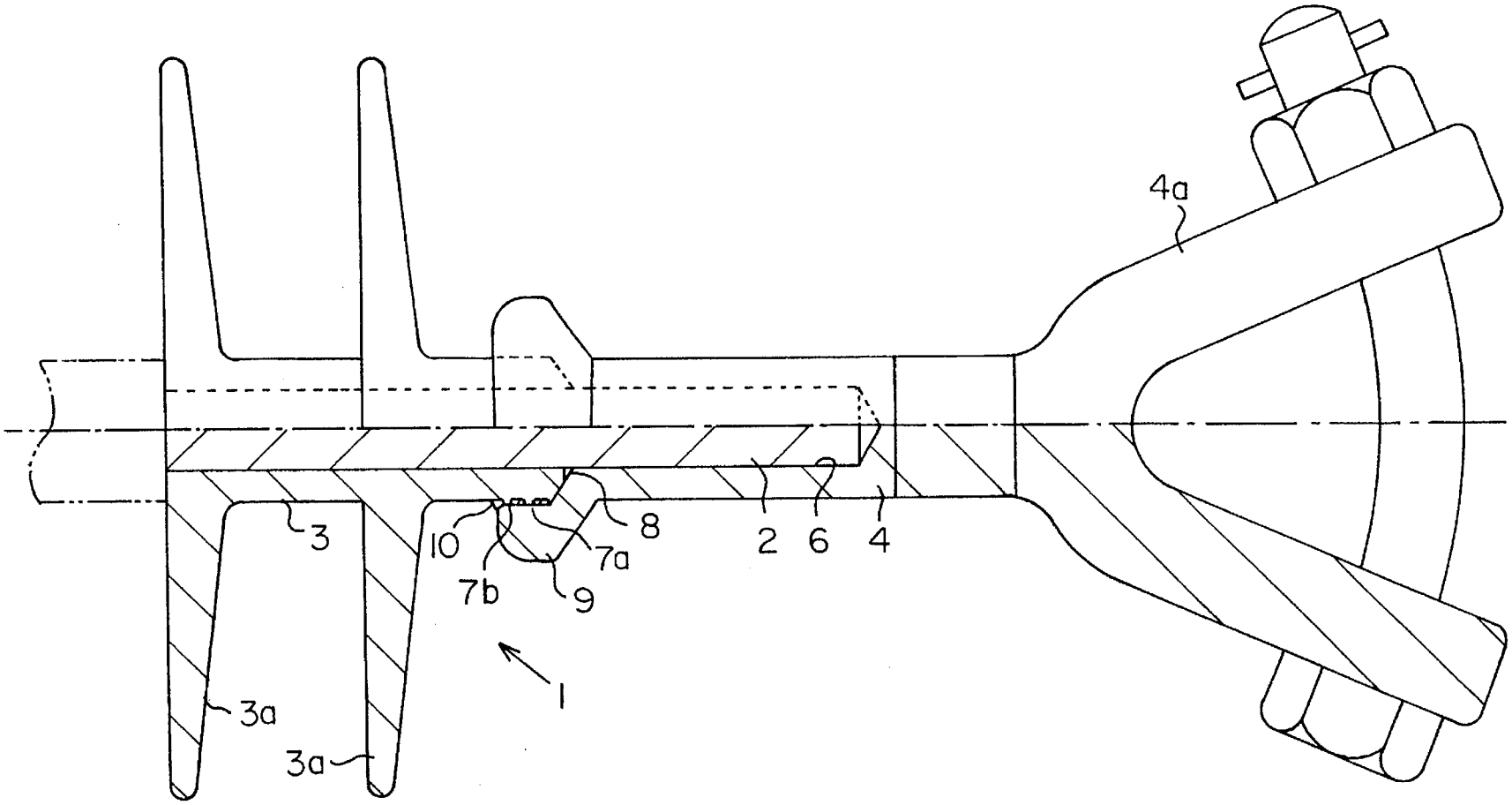
FIG. 1 is a fragmentary front view, partly in longitudinal section, showing a ground side of a composite insulator according to one embodiment of the present invention.
Figure 2:
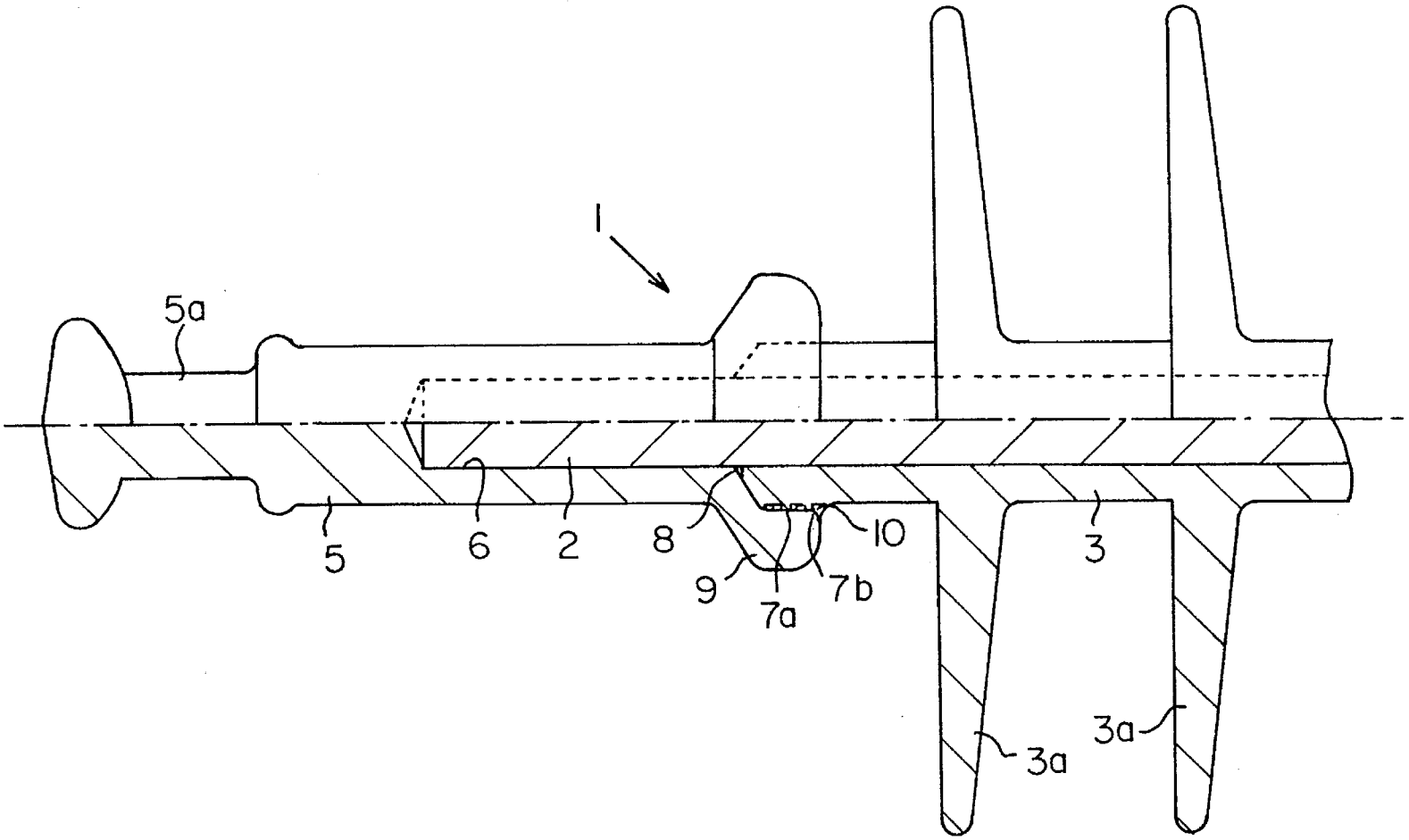
FIG. 2 is a fragmentary front view, partly in longitudinal section, showing a voltage application side of the insulator shown in FIG. 1.

Referring now to FIG. 1, there is shown a composite electrical insulator in the form of an FRP-type insulator, which is denoted as a whole by reference numeral 1, and to which the present invention may be applied. The insulator 1 includes a rod 2 comprised of a fiber-reinforced plastic material, which may be referred as "FRP rod" hereinafter. The FRP rod 2 is covered, either locally or entirely, by an insulating sheath 3 which is comprised of an appropriate resilient and electrically insulating material and provided with a series of shed portions 3*a*. These shed portions 3*a* are axially spaced from each other in a conventional manner, so as to preserve a desired surface leakage distance. There is shown in FIG. 1 a ground side of the insulator 1 where the FRP rod 2 is clamped by a metal fitting 4. The insulator 1 has a voltage application side as shown in FIG. 2, which may also be clamped by a metal fitting 5 with a similar clamp structure.

The fiber-reinforced plastic material forming the FRP rod 2 of the insulator 1 may comprise knitted or woven fibers or bundles of longitudinally oriented fibers, such as glass fibers or other appropriate fibers having a high modulus of elasticity, and a thermosetting type synthetic resin, such as epoxy resin, polyester resin or the like, impregnated in the fibers as a matrix resin. Thus, the FRP rod 2 has a high tensile strength and, hence, a high strength-to-weight ratio.

As mentioned above, the insulating sheath 3 is comprised of a resilient and electrically insulating material. Such material may be, e.g., silicone rubber, ethylenepropylene rubber or the like. The shape of the insulating sheath 3 and the region of the rod 1 to be covered by the insulating sheath 3 may be designed in a conventional manner, in view of proper avoidance of electrical contamination.

Figure 4A:
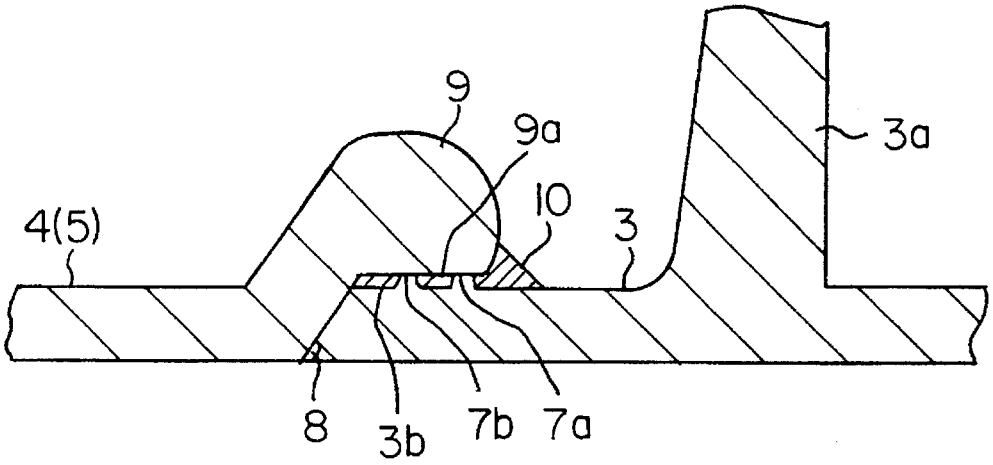
FIG. 4A is a fragmentary longitudinal-sectional view showing the metal fitting and the sheath before fixedly securing the metal fitting to the plastic rod.
Figure 4B:
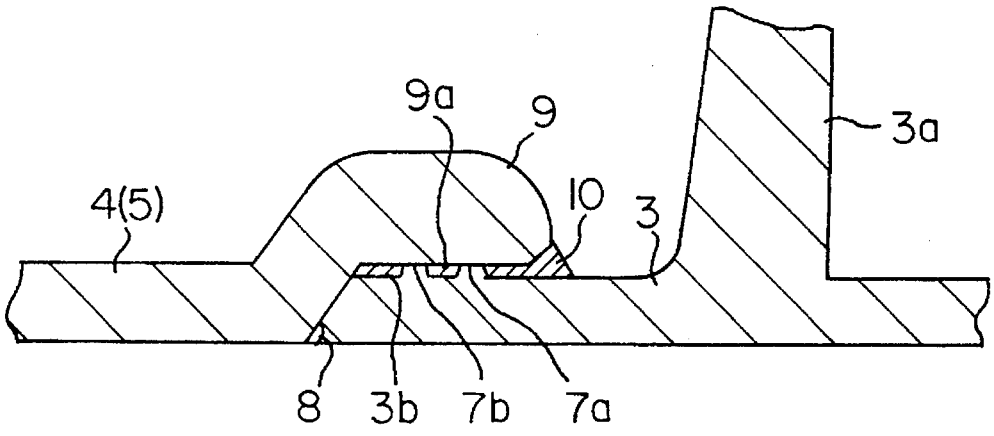
FIG. 4B is a similar sectional view showing the metal fitting and the sheath after the metal fitting has been fixedly secured to the plastic rod.

The metal fittings 4 and 5 may each comprise a high tension steel, aluminum, ductile iron or other appropriate metal, which has been plated by zinc, for example. As can be appreciated from FIGS. 1 and 2, each metal fitting 4, 5 has a sleeve portion which is formed with a longitudinal bore 6 for receiving a corresponding axial end portion of the FRP rod 2. After the axial end portions of the FRP rod 2 covered by the sheath 3 have been inserted into the bores 6 in the corresponding metal fittings 4, 5, as shown in FIG. 4A, predetermined clamp regions in the sleeve portions of the metal fittings 4, 5 which extend over the respective end portions of the FRP rod 2 are subjected to caulking by an appropriate tool, not shown, so as to fixedly clamp the metal fittings 4, 5 to the FRP rod 2, as shown in FIG. 4B.

Incidentally, each metal fitting 4, 5 on its free end 4*a*, 5*a* remote from the FRP rod 2 is adapted to be directly or indirectly connected to an electric cable, support arm of a tower and the like. The free end 4*a* of the metal fitting 4 on the voltage application side is shown in FIG. 1 as being a conventional bifurcated clevis.

Figure 3:
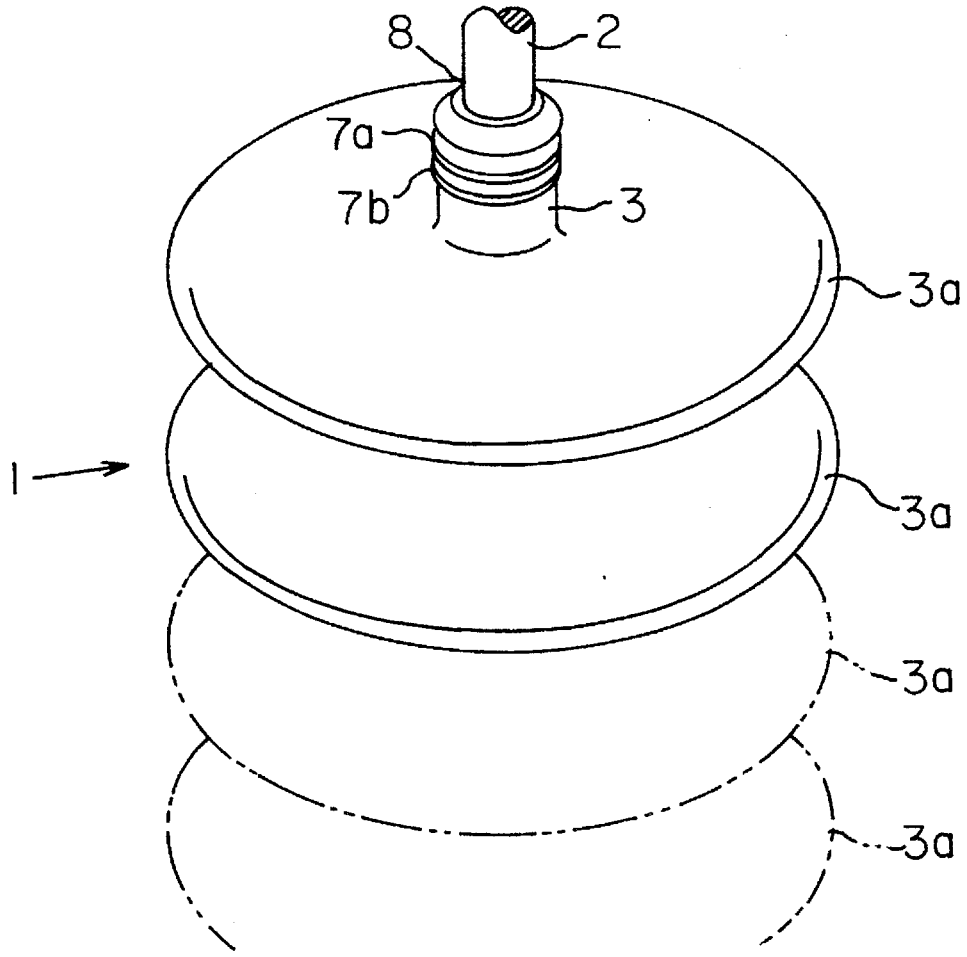
FIG. 3 is a fragmentary perspective view showing the voltage application side of the plastic rod covered by a sheath.

The arrangement according to the present invention is such that, when each metal fitting 4, 5 has been fully clamped to the FRP rod 2, the required water tightness between the metal fitting 4, 5 and the end region of the insulating sheath 3 can be maintained practically permanently. To this end, as particularly shown in FIG. 3 and FIGS. 4A, 4B, the end portion of the sheath 3 situated opposite to the relevant metal fitting 4, 5 is provided on its outer surface with at least one ridge. In the illustrated embodiment, corresponding to each of the metal fittings 4, 5, a pair of such circumferential ridges 7*a*, 7*b* are provided, axially spaced from each other by a predetermined distance. Each ridge 7*a*, 7*b* may have an appropriate cross-section, such as a semi-circular or wavy cross-section.

On each side of the insulator 1, the outer surface of the sheath 3 terminates in a generally frustoconical free end having a radially innermost surface region 8 which is axially depressed. The axially depressed surface region 8 at the free end of the sheath 3 serves to positively prevent separation of the sheath 3 from the FRP rod 2 upon thermal expansion or cooling shrinkage of the sheath 3.

The sleeve portion of each metal fitting 4, 5 has an end region 9 opposite to the shed portions 3*a*, which is bulged radially outwardly providing a smoothly curved surface at the outer peripheral corners so as to avoid a flashover in the insulator. This end region 9 of the metal fitting 4, 5 also serves as a seal region for maintaining the above-mentioned water tightness between the metal fitting 4, 5 and the opposite end region 3*b* of the insulating sheath 3. In order to realize a further improved tightness between the end region 3*b* of the insulating sheath 3 and the metal fitting 4, 5 the gap between the end region 3*b* of the insulating sheath 3 and a seal region 9*a* of the metal fitting 4, 5 may be filled by appropriate sealant resin 10, such as silicone rubber.

It will be appreciated from the foregoing description that the present invention provides an improved composite electrical insulator, which is capable of maintaining the water-tightness between the metal fitting and the sheath without an increased clamping force.

While the present invention has been described with reference to certain preferred embodiments, they were given by way of examples only. Various changes and modifications may be made without departing from the scope of the present invention as defined by the appended claims.

For example, the present invention may be applied to a composite insulator in which the rod comprises an electrically insulating resin other than fiber reinforced plastic material.

We claim:

1. A composite electrical insulator comprising:

a rod comprising an electrically insulating plastic material, said rod having an end portion;

a sheath covering at least a portion of said rod and having an end portion proximate said end portion of said rod, said sheath comprising a resilient and electrically insulating material; and a metal fitting having a sleeve portion formed with a bore in which said end portion of said rod and said end portion of said sheath are received, said sleeve portion having a radially inwardly deformed region for tightly clamping at least said end portion of said rod;

said end portion of said sheath having an outer substantially cylindrical surface opposed and substantially parallel to an inner substantially cylindrical surface of said metal fitting, with at least one circumferential ridge formed on said outer surface of said sheath, wherein said at least one circumferential ridge is the only portion of said outer surface of said sheath that contacts said inner surface of said metal fitting.

2. The insulator of claim 1, wherein said outer surface of said sheath comprises a plurality of circumferential ridges axially spaced from each other by a predetermined distance.

3. The insulator of claim 1, wherein said at least one circumferential ridge has a semi-circular cross-section.

4. The insulator of claim 1, wherein said end portion of said sheath terminates in a generally frustoconical free end having a radially innermost surface region which is axially depressed.

5. The insulator of claim 1, wherein said metal fitting further comprises an end region adjacent said end portion of said sheath, and said insulator further comprises a sealant resin interposed between an inner surface of said end region and said outer surface of said sheath.

6. The insulator of claim 1, wherein said rod comprises a fiber reinforced plastic material.

* * * * *